US008439018B2

(12) United States Patent
Kabasin et al.

(10) Patent No.: US 8,439,018 B2
(45) Date of Patent: May 14, 2013

(54) HEATED FUEL INJECTOR SYSTEM

(75) Inventors: Daniel Francis Kabasin, Rochester, NY (US); Orlando Volpato, Piracicaba (BR); Brian Keith Allston, Rochester, NY (US); Charles Anthony Iannone, West Henrietta, NY (US)

(73) Assignee: Delphi Technologies, Inc., Troy, MI (US)

( * ) Notice: Subject to any disclaimer, the term of this patent is extended or adjusted under 35 U.S.C. 154(b) by 574 days.

(21) Appl. No.: 12/773,251

(22) Filed: May 4, 2010

(65) Prior Publication Data

US 2011/0276252 A1 Nov. 10, 2011

(51) Int. Cl.
*F02G 5/00* (2006.01)

(52) U.S. Cl.
USPC ..... 123/549; 239/132; 73/114.45

(58) Field of Classification Search ..... 123/549, 123/543; 239/128, 132, 133, 135; 73/114.45
See application file for complete search history.

(56) References Cited

U.S. PATENT DOCUMENTS

| | | | | |
|---|---|---|---|---|
| 3,601,110 | A * | 8/1971 | Kamazuka | 123/179.15 |
| 3,868,939 | A * | 3/1975 | Friese et al. | 123/179.15 |
| 3,999,525 | A * | 12/1976 | Stumpp et al. | 123/557 |
| 4,886,032 | A * | 12/1989 | Asmus | 123/557 |
| 5,054,458 | A * | 10/1991 | Wechem et al. | 123/549 |
| 5,201,341 | A * | 4/1993 | Saito et al. | 137/341 |
| 5,284,117 | A * | 2/1994 | Akase | 123/445 |
| 5,401,935 | A * | 3/1995 | Smith et al. | 219/206 |
| 5,758,826 | A * | 6/1998 | Nines | 239/136 |
| 6,592,052 | B2 | 7/2003 | Hokao | |
| 6,688,533 | B2 * | 2/2004 | Nines et al. | 239/5 |
| 7,249,596 | B2 * | 7/2007 | Pellizzari et al. | 123/549 |
| 7,337,768 | B2 * | 3/2008 | Elia et al. | 123/549 |
| 7,357,124 | B2 * | 4/2008 | Elia et al. | 123/549 |
| 7,472,839 | B2 | 1/2009 | Yasukawa et al. | |
| 7,481,205 | B2 * | 1/2009 | Keeler et al. | 123/549 |
| 7,516,733 | B2 * | 4/2009 | Stephan et al. | 123/445 |
| 7,669,585 | B2 * | 3/2010 | Haag et al. | 123/456 |
| 7,681,558 | B2 | 3/2010 | Gale et al. | |
| 7,958,721 | B2 * | 6/2011 | Craig et al. | 60/286 |
| 8,256,691 | B2 * | 9/2012 | Bolz et al. | 239/135 |
| 2002/0139871 | A1 | 10/2002 | Hokao et al. | |
| 2005/0263136 | A1 * | 12/2005 | Rigney | 123/470 |
| 2009/0266343 | A1 * | 10/2009 | Lecca et al. | 123/557 |
| 2010/0018962 | A1 * | 1/2010 | Kabasin et al. | 219/482 |
| 2011/0180624 | A1 * | 7/2011 | Czimmek | 239/135 |

OTHER PUBLICATIONS

Daniel Kabasin, Kevin Hoyer & Joseph Kazour, "Heated Injectors for Ethanol Cold Starts" 2009 SAE International, 2009-01-0615.

Daniel Kabasin, Joseph Kazour, Bill Fedor & Scott Geiger, "Emission Reduction with Heated Injectors" 2010 SAE International , 2010-01-1265.

* cited by examiner

*Primary Examiner* — Thomas Moulis
(74) *Attorney, Agent, or Firm* — Lawrence D. Hazelton

(57) ABSTRACT

A heated fuel injector system and controller that includes a temperature sensing means to provide closed-loop control of a heating element heating fuel dispensed by a heated fuel injector. Closed-loop control provides more accurate temperature control of the heating element so that fuel heating is provided as quickly as possible while also protecting the fuel from being boiled and protecting the heated fuel injector from being damaged by excessive temperature. By monitoring how the signal from the temperature sensing means varies over time, fault conditions such as a lack of fuel flow, and fuel ethanol percentage may be detected.

20 Claims, 8 Drawing Sheets

HEATED FUEL INJECTOR SYSTEM

TECHNICAL FIELD OF INVENTION

The invention generally relates to heated fuel injectors, and more particularly relates to a system providing a temperature sensing means to enable closed loop temperature control of fuel dispensed by a heated fuel injector.

BACKGROUND OF INVENTION

It is known that heating fuel consumed by an internal combustion engine during a cold start, particularly fuel comprising alcohol, reduced hydrocarbon (HC) and carbon monoxide (CO) emissions. The Society of Automotive Engineers publications entitled Heated Injectors for Ethanol Cold Starts (SAE 2009-01-0615) by Daniel Kabasin et al. and Emission Reduction with Heated Injectors (SAE 2010-01-1265) by Daniel Kabasin et al. document the benefits of using heated fuel injectors to reduce engine emissions, the entire contents of which are hereby incorporated by reference herein. The temperature control of such heated injectors typically uses an open loop approach that regulates power to a heater element based on extensive empirical testing of output fuel temperatures for various fuel flow rates, ambient temperatures, coolant temperatures, elapsed time from initiation of crank, and estimated fuel flow rates. The open-loop temperature control is supposed to keep the heater element temperature below a maximum failure temperature of the heater element, below a melting temperature of a protective plastic covering the heater element, and below the boiling temperature of the fuel resident in the injector. This open-loop control also considers manufacturing variation of heater resistances and so requires a safety margin in the power applied to the heaters in order to avoid vapor lock or damage due to excessive heating. Consequently, the open-loop approach may result in less than optimal heating of the fuel and/or failed cold starts.

SUMMARY OF THE INVENTION

In accordance with one embodiment of this invention, a heated fuel injector system for heating fuel dispensed by a heated fuel injector is provided. The system includes a heated fuel injector, a heater element, and a temperature sensing means. The heated fuel injector is operable to controllably dispense a fuel. The heater element is arranged to heat the fuel dispensed by the heated fuel injector. The temperature sensing means is configured to output a temperature signal indicative of a fuel temperature of the fuel dispensed by the heated fuel injector.

In another embodiment of the present invention, a controller for operating a heated fuel injector is provided. The controller includes a temperature signal input and an electric power regulator. The temperature signal input is configured to receive a signal indicative of a fuel temperature of a fuel dispensed by the heated fuel injector. The electric power regulator means is configured to regulate electric power to a heater element based on the temperature signal.

Further features and advantages of the invention will appear more clearly on a reading of the following detail description of the preferred embodiment of the invention, which is given by way of non-limiting example only and with reference to the accompanying drawings.

BRIEF DESCRIPTION OF DRAWINGS

The present invention will now be described, by way of example with reference to the accompanying drawings, in which.

DETAILED DESCRIPTION OF INVENTION

Figure 1:
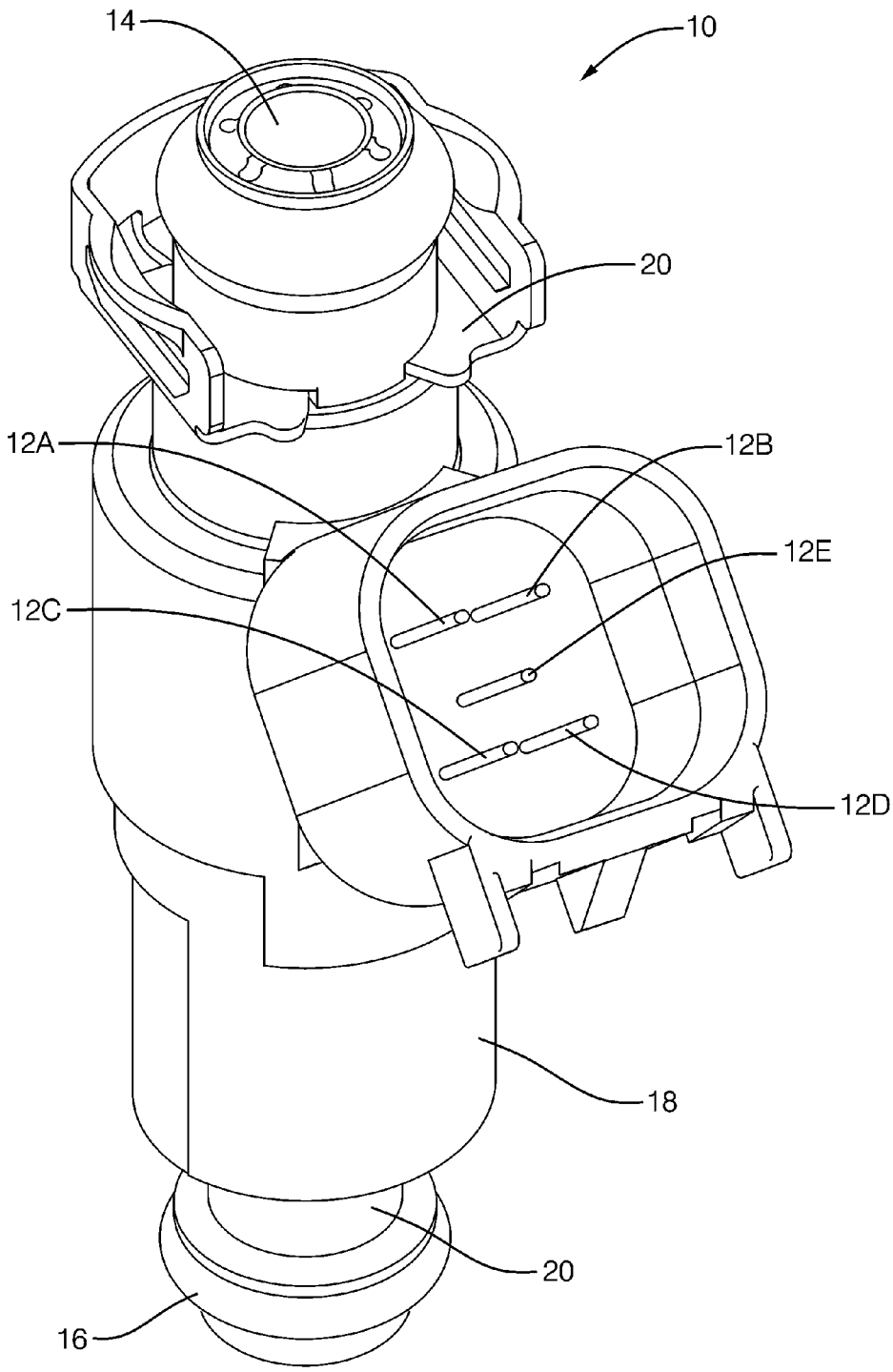
FIG. 1 is a perspective view of a heated fuel injector in accordance with one embodiment.

In accordance with an embodiment of a heated fuel injector system, FIG. 1 illustrates an exemplary heated fuel injector 10 having five connector pins 12*a*-12*e*, a fuel inlet end 14, a fuel dispensing end 16, and a shell 18 overlying a fuel injector body 20. Typically, the heated fuel injector 10 would be attached to an internal combustion engine, the fuel inlet end 14 would be coupled to a source of pressurized fuel, and the fuel dispensing end 16 would be positioned so fuel passing through the body 20 would be dispensed by the heated fuel injector 10 to be utilized by the engine to operate the engine. By way of a non-limiting example, connector pins 12*a* and 12*b* may be coupled to an actuation coil (not shown) within the body 20 of the heated fuel injector 10 that operates a valve (not shown) also within the body 20 and generally located at the fuel dispensing end 16. Continuing with the example, if a voltage is applied across connector pins 12*a* and 12*b*, the valve may open to allow fuel to flow from the fuel inlet end 14, through the body 20, and out of the fuel dispensing end 16. When the voltage is removed or actively forced to zero volts, the valve may close and stop or obstruct the flow of fuel. By alternating the voltage applied to the connector pins 12*a* and 12*b*, the heated fuel injector 10 may be operated to controllably dispense the fuel.

Figure 2:
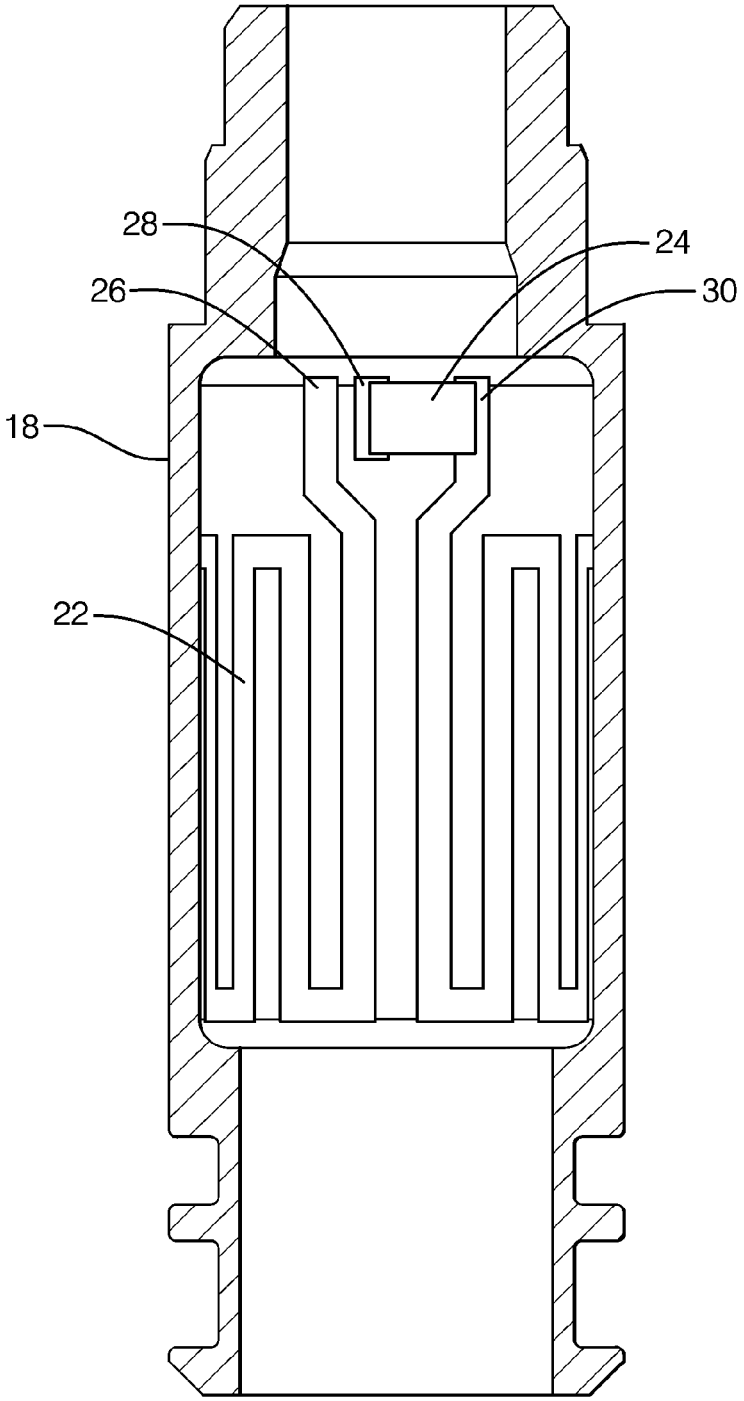
FIG. 2 is a cut-away view of part of the heated fuel injector in FIG. 1 in accordance with one embodiment.

FIG. 2 illustrates cut-away view of the shell 18 with the body 20 removed. A heater element 22 formed of electrically conductive material is arranged to heat the fuel within the body 20 so that heated fuel may be dispensed by the heated fuel injector 10. The heater element 22 exhibits a heater resistance so that as electric current flows through the heater element 22 heat is generated that increases a heater temperature and thereby heats the heater element 22 and increases a fuel temperature. An exemplary non-limiting value of the resistance of the heater element 22 is nominally 0.3 Ohms at 20° C. When the heated fuel injector 10 is assembled, the heater element 22 is suitably thermally coupled to the body 20 to be effective to heat fuel passing through the body 20. The heater element 22 may be formed, for example, of thick-film resistive material that may be applied to the exterior of the body 20, or applied to the interior of the shell 18. Alternately, the heater element 22 may be formed of metal foil or wire that is suitably arranged to heat the fuel injector body 20 and thereby heat the fuel passing through the heated fuel injector 10. The heater element 22 may be connected to the connector pins 12*c* and 12*d* by soldering or other known methods.

Figure 7A:
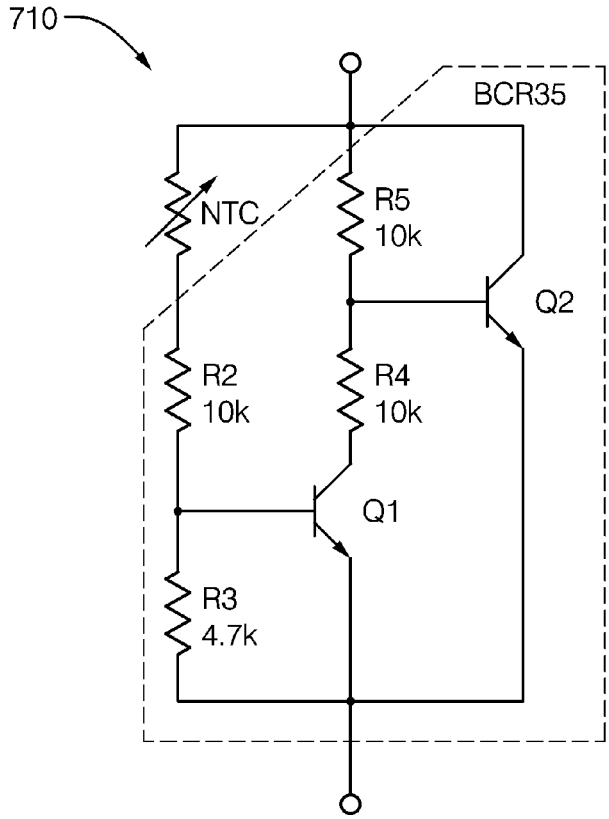
FIGS. 7A-C are schematic diagrams of temperature indicator circuits suitable for use in FIG. 3 in accordance with one embodiment.
Figure 7B:
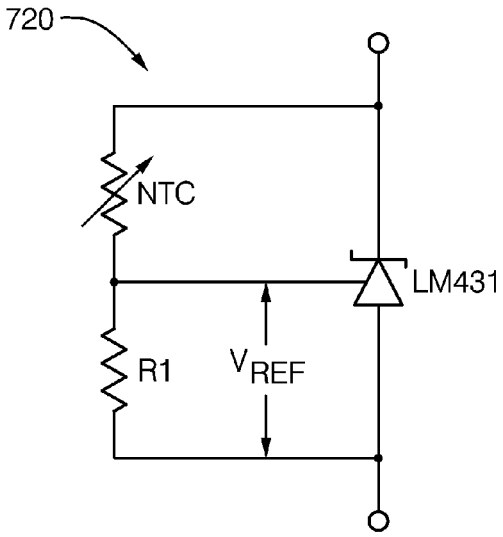
Figure 7C:
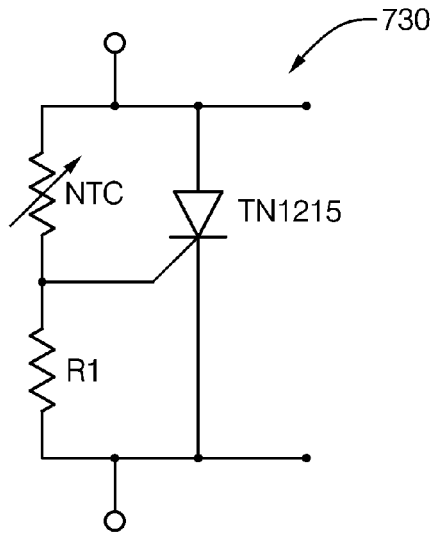

The heated fuel injector system also includes a temperature sensing means configured to output a temperature signal or exhibit an electrical characteristic indicative of a fuel temperature of the fuel within the body 20 and/or the fuel dispensed by the heated fuel injector 10. FIG. 2 illustrates one embodiment of the temperature sensing means as a thermistor 24. The thermistor 24 generally exhibits a resistance value that corresponds to a thermistor temperature of the thermistor 24. The thermistor 24 may also be formed of thick film material applied using methods similar to those used to apply thick film material to form the heater element 22. The thermistor 24 may also be a discrete electrical component such as a positive temperature coefficient (PTC) or negative temperature coefficient (NTC) device attached using solder or the like. Unless stated otherwise and for the purposes of discussion, it should be assumed that the thermistor 24 has a positive temperature coefficient. It would be apparent to those skilled in the art how to adapt any of the exemplary embodiments to a negative temperature coefficient thermistor. The location of this sensor 24 shown in FIG. 2 is a non-limiting example of suitable locations. For example, the thermistor 24 when formed of thick film material may overlay the heater element 22, separated from the heater element 22 by a layer of electrically insulating material, and be sized to sense temperature over a substantial area of the heater element 24. Alternately, the temperature sensing means may be a temperature indicator circuit, several examples of which are illustrated in FIG. 7 and described in more detail below.

In one embodiment, the thermistor 24 is coupled to a connector pin also used by the heater element 22, 12*b* for example, so that only three terminals (12*c*, 12*d*, and 12*e*) are needed to make an electrical connection to a heater contact 26, a thermistor contact 28, and a common contact 30 illustrated in FIG. 2. By arranging the thermistor 24 to be thermally coupled to the fuel passing through the injector body, or to the surface of the heater element 24, the thermistor 24 will exhibit a thermistor resistance indicative of the fuel temperature and/or the heater temperature, respectively. By arranging the thermistor or other temperature sensing means to be thermally coupled to the fuel being dispended by the heated fuel injector, the temperature signal may directly correspond to the fuel temperature of the fuel dispensed by the heated fuel injector. The thermistor 24 may be electrically coupled to any of a number of known electrical networks, such as a voltage divider network, adapted to output a temperature signal that is based on the thermistor resistance and is thereby indicative of the fuel temperature of the fuel dispensed by the heated fuel injector, or the fuel temperature of fuel in the body 20, or the heater temperature.

In another embodiment, the heated fuel injector 10 may have four connector terminals (12*a*, 12*b*, 12*c*, 12*d*) instead of five connector terminals (12*a*, 12*b*, 12*c*, 12*d*, 12*e*) as illustrated in FIG. 1. For this embodiment, the actuator coil, heater element 22, and thermistor 24 may all have one connection in common, and the remaining three connector terminals are coupled to the other ends of each of the actuator coil, heater element 22, and thermistor 24. Such an arrangement may reduce the cost of the heated fuel injector 10. By way of a non-limiting example, electrical power supplied to the heater element 22 may be pulse-width-modulated (PWM) waveform, modulated to regulate the average power supplied. In this case, the voltage applied to the heater element 22 may be periodically interrupted, and during this interrupted time a thermistor resistance may be determined.

Figure 3:
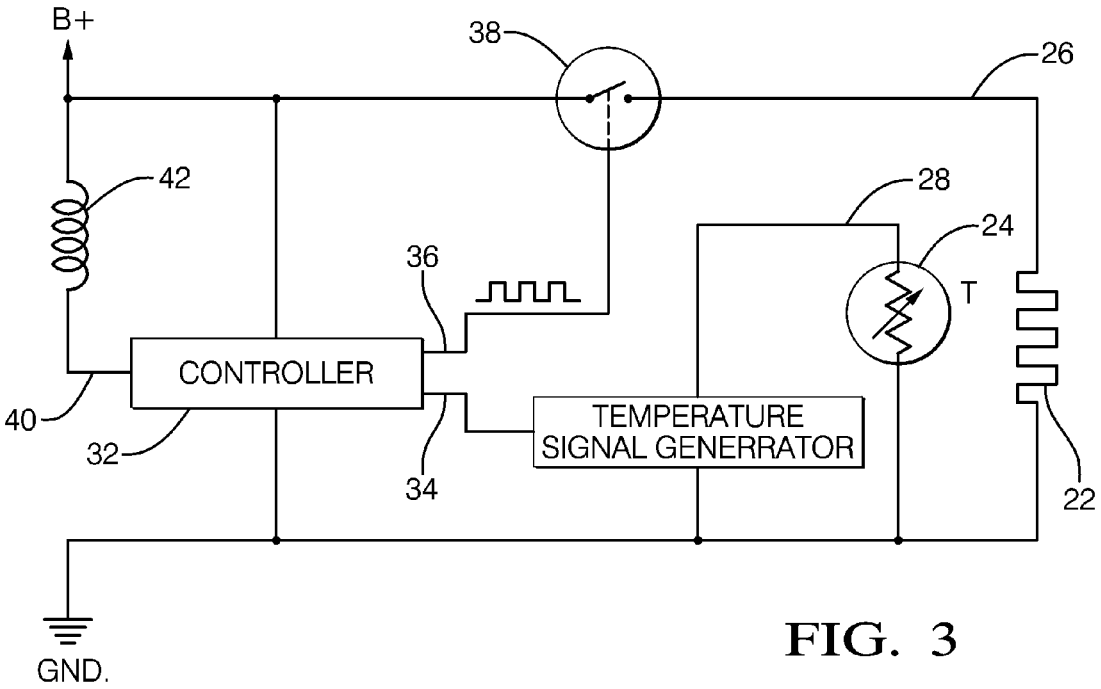
FIG. 3 is a circuit diagram of a heated fuel injector system for operating the heated fuel injector in FIG. 1 in accordance with one embodiment.

FIG. 3 illustrates a circuit diagram useful for describing the operation of an embodiment of the heated fuel injector system. The system may include a controller 32 configured to receive a temperature signal 34, and regulate electric power to the heater element 24 based on the temperature signal 34. The controller 32 may output a power switch control signal 36 that is effective to open and close a power switch 38 and thereby modulate power to the heater element 22. The power switch 38 is illustrated as a mechanical switch. However, it is understood that the power switch 38 may suitably be a relay or a solid state switch such as a transistor. In one embodiment the controller 32 may pulse width modulate or frequency modulate the power switch control signal 36 to regulate the heating power supplied to the heater element 22 and thereby control the temperature of the heater element 22. Alternately, the power switch may be a transistor that is operated in a linear mode by the switch control signal 36.

The controller 32 may include a microprocessor or other control circuitry as would be evident to those skilled in the art. The controller 32 may include memory, including non-volatile memory, such as electrically erasable programmable read-only memory (EEPROM) for storing one or more routines, thresholds and captured data. The one or more routines may be executed by the microprocessor to generate the switch control signal 36. The controller 32 and other components shown in FIG. 3 may be integrated within the heated fuel injector 10 so the heated fuel injector 10 may operate in an autonomous manner, independent of the engine control system. The controller 32 may provide a time-out function can give this heated fuel injector 10 additional stand-alone capability whereby the controller 32 determines to connect the heater element 22 to electrical power based on the temperature signal 34. For example, the controller 32 may only supply electrical power to the heater element 22 if the temperature signal 34 indicates that the temperature is below 30° C. The controller 32 may also include programming to disconnect the heater element 22 after a pre-determined time following either being initially energized or following the energizing of an injector actuator coil 42.

Figure 9:
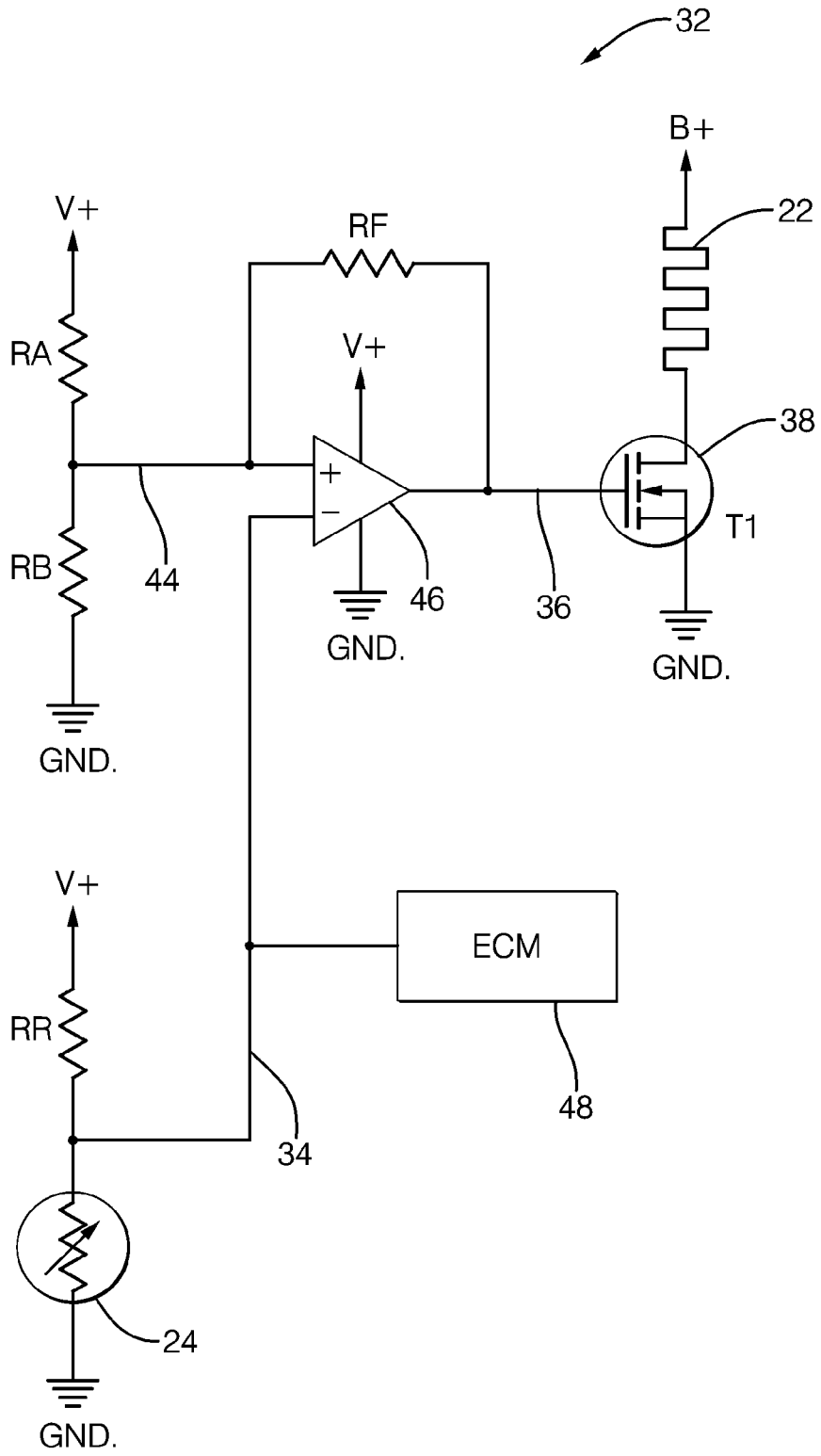
FIG. 9 is a circuit diagram of a heater control circuit for operating the heated fuel injector in FIG. 1 in accordance with one embodiment.

FIG. 9 illustrates a non-limiting example of a portion of the controller 32 that includes a comparator means in the form of a comparator 46 arranged to receive the temperature signal 34 and a reference signal 44, and output a switch control signal 36 based on a comparison of the temperature signal 34 and the reference signal 44. Alternately, the comparator means may be provided by an amplifier such as an LM2904, or may be provide by a microprocessor executing a program that inputs the temperature signal 34 and the reference signal 44, and outputs the switch control signal 36 in accordance with the program. A reference voltage V+ may be supplied by an adjustable voltage reference (not shown) or the reference voltage V+ may be derived from a vehicle supply voltage B+. A reference resistor RR is arranged with the thermistor 24 to form a voltage divider network that generates the temperature signal 34 corresponding to a fraction of the reference voltage V+. A second voltage divider network is formed by a series combination of resistors RA and RB to generate the reference signal 44 corresponding to a fraction of the supply voltage V+. An exemplary value for RA, RB, and RR is 10 kOhm, and thermistor 24 may be selected to have a resistance of about 10 kOhm at a desired control temperature, such as 150 C. The controller 32 may also include a hysteresis feedback resistor RF having a non-limiting exemplary value of 10 Mega Ohm. Including the resistor RF in the circuit reduces the risk of electrical noise causing rapid switching of the comparator 46. In this example, a transistor T1 serves as the power switch 38 and is operated by the switch control signal 36 to modulate power to the heater element 22. The transistor T1 is selected based on the voltage of the supply voltage B+, the expected current through heater element 22, and the ambient operating temperature experienced by transistor T1. By this exemplary arrangement, if the voltage of the temperature signal 24 is less than the voltage of the reference signal 34 by an amount sufficient to overcome the hysteresis provided by hysteresis resistor RF, the transistor T1 is turned on by the comparator 46 so that electric power is supplied to the heater element 22 to heat the heated fuel injector 10. When the temperature signal 24 is greater than the voltage of the reference signal 34 by an amount sufficient to overcome the hysteresis provided by hysteresis resistor RF, the transistor T1 is turned off by the comparator 46 so that electric power to the heater element 22 is blocked.

Figure 4:
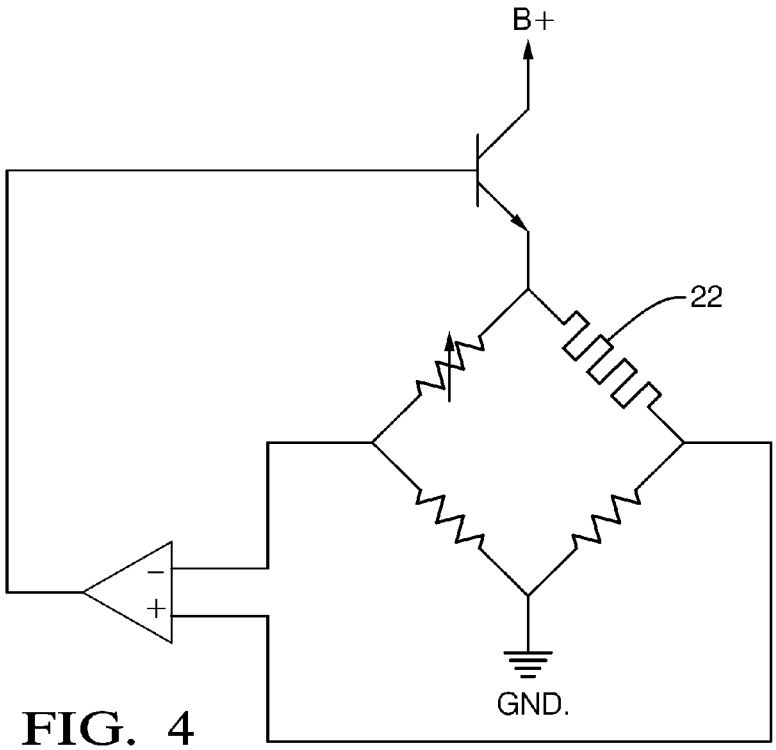
FIG. 4 is a circuit diagram of a heater control circuit for operating the heated fuel injector in FIG. 1 in accordance with one embodiment.

In FIG. 3 the thermistor and the heater element are distinct electrical devices. FIG. 4 illustrates another embodiment of a temperature control circuit where the temperature sensing means may be provided by using the resistance of the heater element 22 to monitor heater temperature and provide an indicator of fuel temperature. For such an embodiment, the heater element 22 is suitably formed of a material having a non-zero temperature coefficient of resistance so that the heater element 22 exhibits a heater resistance corresponding to the heater temperature. As such, the heater resistance may be indicative of the fuel temperature. In this embodiment, the heater element 22 may form part of a Wheatstone bridge network configured to control the temperature of the heater element 22 by using the heater resistance to influence the balance of the Wheatstone bridge. As suggested by the illustration, one or more of the other three resistors completing the Wheatstone bridge may be adjusted to calibrate the Wheatstone bridge and thereby compensate for part to part variation of the heater resistance. Alternately, the temperature sensing means of the heated fuel injector system may include a current measuring means configured to measure the current passing through the heater element 22, and a voltage measuring means configured to measure the voltage drop across the heater element 22. It follows then that the heater resistance may be calculated based on the current through the heater element 22 and the voltage across the heater element, and so the heater temperature may be determined.

Figure 5:
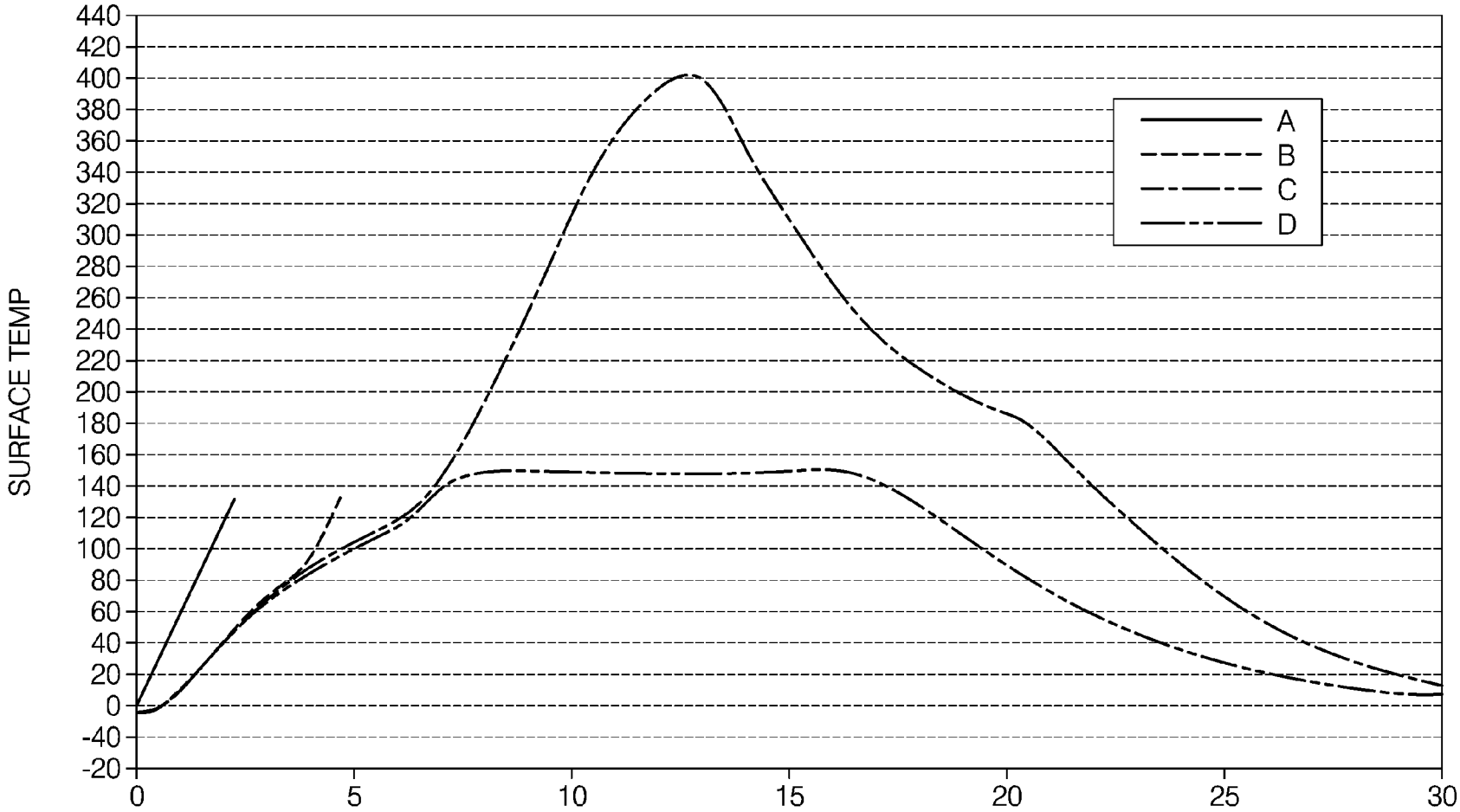
FIG. 5 is a graph of temperature signals within the heated fuel injector in FIG. 1 in accordance with one embodiment.

It has been discovered that a time-rate-change characteristic of the temperature signal 34 may be useful to diagnose the heated injector system or determine an operating condition such as, but not limited to, an empty injector condition, a low fuel pressure condition, a lack of fuel flow condition, or an onset of fuel boiling condition. FIG. 5 shows time-rate-change characteristics of the temperature signal 34 for several exemplary operation conditions. Curve A on FIG. 5 corresponds to the empty injector condition. If there is no fuel or other liquid in the heated fuel injector 10, then the thermal mass of the heated fuel injector 10 is relatively low and so the time-rate-change characteristic has a relatively high slope. Curve B corresponds to the low fuel pressure condition where the pressure of fuel in the heated fuel injector is lower than normal. Here the temperature initially rises at a rate slower than Curve A because the thermal mass has increased due the presence of fuel, but the fuel present begins to boil as indicated by the increase in the slope of the time-rate-change characteristic. Curve C corresponds to the lack of fuel flow condition. Here, the fuel is pressurized at a pressure higher that for curve B and so the onset of boiling is delayed. However, once boiling begins, the slope increases to a value comparable to the slope of curve B after the onset of fuel boiling. Curve D corresponds to and normally pressurized fuel flowing at some typical rate so the temperature rises at a lower rate than the previously described curves. However, the plateau where the slope of the curve is about zero is at a temperature provides an indication that fuel is beginning to boil. The plateau effect is due to the rapid heat transfer of heat away from the heater element caused by the continuous vaporization of flowing fuel.

Figure 6:
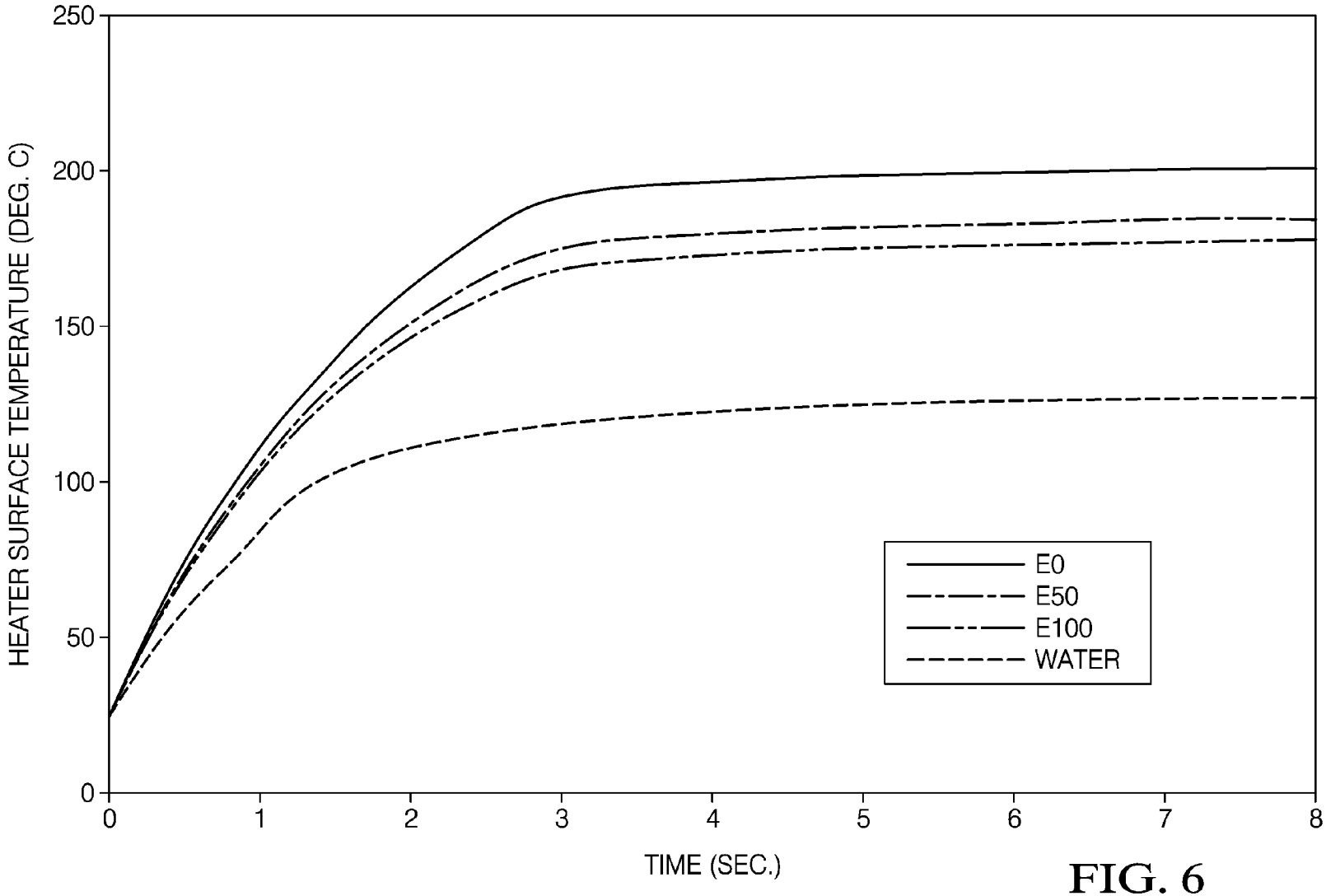
FIG. 6 is a graph of temperature signals within the heated fuel injector in FIG. 1 in accordance with one embodiment.

It has also been discovered that the time-rate-change characteristic of the temperature signal 34 may be useful to estimate an ethanol percentage of the fuel. FIG. 6 shows time-rate-change characteristics of the temperature signal 34 for three different ethanol percentages. By analyzing the slope of heater temperature rise and/or plateau temperature and taking into account the fuel flow the ethanol percentage of the fuel may be determined. Knowing the ethanol percentage based on the time-rate-change characteristic may be used by an engine control system to confirm a reading from a separate ethanol sensor or may allow the ethanol sensor to be eliminated from the engine control system and thereby save cost.

Furthermore, the time-rate-change characteristic of the temperature signal 34 may be useful to provide an indication of water being present in the heated fuel injector. FIG. 6 shows a time-rate-change characteristics of the temperature signal 34 for water. Detecting the presence of water in the fuel may be particularly useful for fuel with high ethanol concentration levels since ethanol and water form a liquid solution.

In another embodiment, the temperature sensing means may be a temperature indicator circuit. As used herein, a temperature indicator circuit is generally a network of electrical components that exhibits an electrical characteristic indicative of temperature. In one non-limiting example, the electrical characteristic may be a voltage exhibited by the temperature indicator circuit that generally corresponds to a Zener voltage that varies with temperature. In another non-limiting example, the electrical characteristic may be generally characterized as switching between an open circuit and a resistive value based on the temperature about the temperature indicator circuit. FIG. 7 illustrates exemplary temperature indicator circuits 710, 720, and 730 that form two-terminal networks that may be used in place of the thermistor 24 described above. For example, temperature indicator circuit 710 includes a negative temperatures coefficient (NTC) thermistor coupled to a resistor/transistor network as shown. When the temperature is relatively low, transistors Q1 and Q2 are biased off and so the resistance value of the network is relatively high and may be characterized as an open circuit. As the temperature increases, the resistance value of the NTC decreases until transistors Q1 and Q2 are turned on whereby the electrical characteristic of the network is a voltage drop having a voltage value dependent on temperature. A BCR35 from Infineon includes the resistors and transistors illustrated in the integrated circuit 710. Another exemplary temperature indicator circuits may use an LM431 Zener Shunt Regulator as illustrated in temperature indicator circuit 720, or a TN1215 Thyristor Silicon Controlled Rectifier as illustrated in temperature indicator circuit 730. Other suitable networks may also afford a temperature characteristic that switches between an open circuit and a short circuit based on the temperature about the temperature indicator circuit.

Figure 8A:
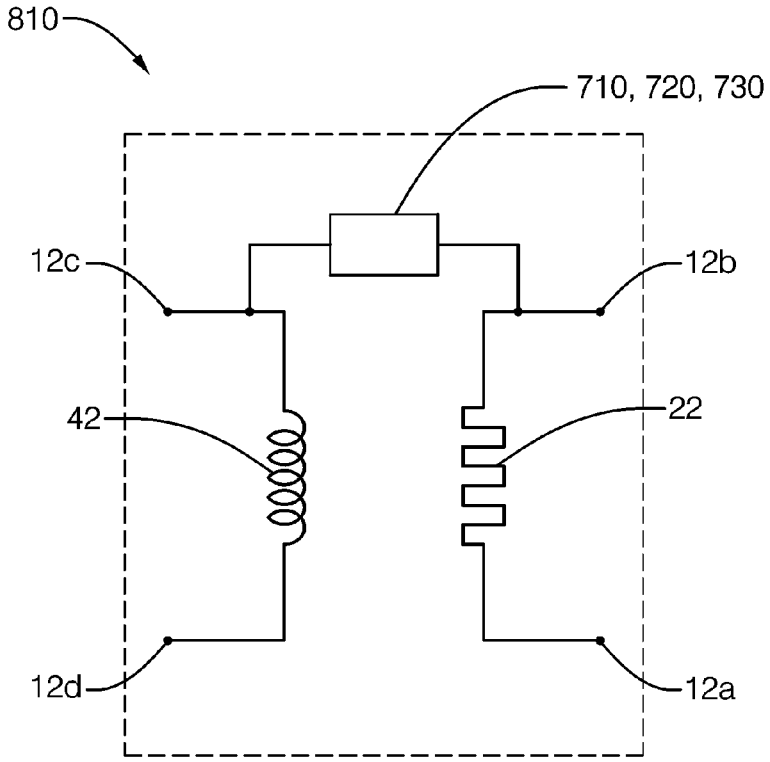
FIGS. 8A-B are schematic diagrams the heated fuel injector in FIG. 1 in accordance with two embodiments.
Figure 8B:
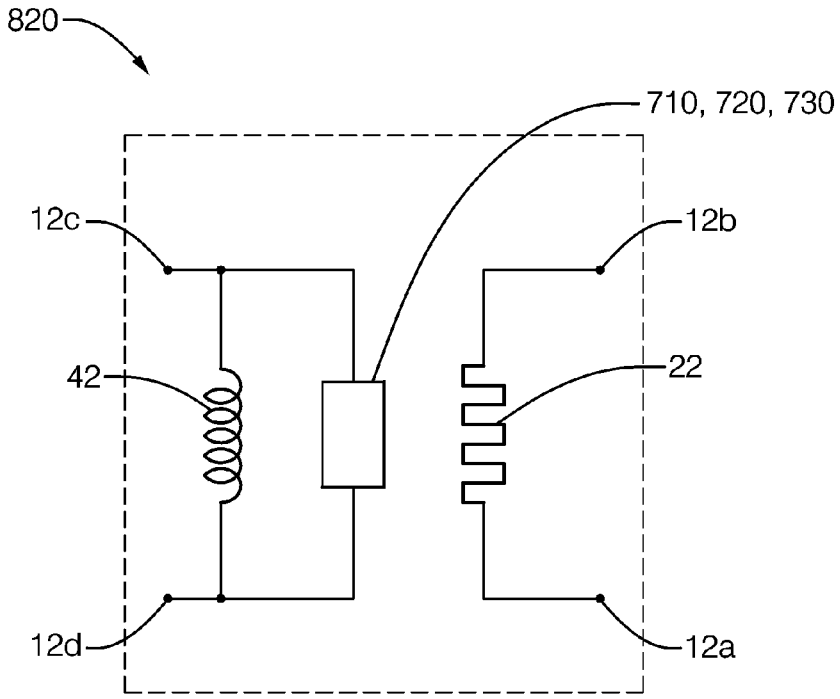

In another embodiment, the heated fuel injector 10 may have four connector terminals (12*a*, 12*b*, 12*c*, 12*d*) instead of five connector terminals (12*a*, 12*b*, 12*c*, 12*d*, 12*e*) illustrated in FIG. 1. For this embodiment a temperature indicator circuit such as one of those illustrated in FIG. 7 may be electrically coupled to the heater element 22 and the actuator coil 42 to form exemplary networks 810 or 820 as illustrated in FIG. 8. The network 810 has a temperature indicator circuit 710, 720, or 730 arranged to couple the injector actuator coil 43 to the heater element 22. By this arrangement, when no voltage is being applied to the injector actuator coil 42 or the heater element 22, then the corresponding pin 12*b* or 12*c* may be monitored to detect if the temperature indicator circuit exhibits an open circuit or a closed circuit. Alternately, the temperature indicator circuit may be coupled to the injector actuator coil as illustrated for network 810. For this arrangement, if the temperature indicator circuit is exhibiting a short circuit, then the current drawn when the injector actuator coil is energized may be monitored, or the back EMF voltage that occurs when the injector actuator coil is de-energized may be monitored.

FIG. 9 shows an embodiment where a temperature signal 34 may be output for the purpose of diagnosing an operating condition of the heated fuel injector 10. By way of a non-limiting example, an Engine Control Module (ECM) 48 may receive the temperature signal 34 for the purpose of diagnosing the operating condition of the heated fuel injector 10. The ECM 48 may be a general purpose engine controller that inputs signals from a variety of engine sensors (not shown) such as a crank sensor or an engine intake airflow sensor, an outputs signals to a variety of engine devices (not show) such as an electronically controlled throttle body or an exhaust recirculation control valve. An operating condition of the heated fuel injector 10 may be indicated by the temperature signal 34 if the temperature signal 34 is substantially equal to the reference voltage V+, whereby an open circuit connection to ground (GND) may be indicated. If the temperature signal 34 is substantially equal to GND, then an open circuit connection to reference voltage V+ and/or battery supply voltage B+ may be indicated. Those skilled in the art will appreciate that other operating conditions such as those suggested above regarding FIG. 5 and FIG. 6 may be indicated by analyzing the temperature signal 34. It should be appreciated that the heater control circuit shown in FIG. 9 may be adapted to either the 5-pin heated fuel injector 10 illustrated in FIG. 1, or may be adapted to a 4-pin version by integrating the electronics within the heated fuel injector and coupling V+ and B+ to the positive supply voltage B+ for the injector coil 43 as shown in FIG. 3.

The ECM 48 may be further configured to output a signal onto the connection with the temperature signal 34 to influence the heater control circuit shown in FIG. 9. For example, if the temperature signal 34 were shorted to the reference voltage V+, then the switch control signal 36 would be held low such that the power switch 38 would not turn on to supply electrical power to the heater element 22. By this, the temperature sensing means may be further configured to receive a heater circuit disable signal from the ECM 48, or receive a signal to influence the fuel temperature of the fuel dispensed by the heated fuel injector 10. In another exemplary embodiment, the ECM 48 may connect one end an additional resistor to the temperature signal 34 connection and the other end of the additional resistor to either the reference voltage V+ or ground GND to change the value of the temperature signal 34 and thereby change the target control temperature of the heated fuel injector 10.

Accordingly, a heat fuel injector system, a heated fuel injector 10, and a controller 32 are provided. The inclusion of a temperature sensing means in the heated fuel injector 10 provides for closed-loop heater element control that avoids under-heating of the fuel, thereby more effectively reducing engine emissions, and avoids over-heating the heated fuel injector, thereby avoiding vapor lock and damage to the injector. The fuel temperature can be more accurately controlled and less influenced by variations in fuel flow rate, fuel formulations', and ambient temperatures. Furthermore, the time-rate-change characteristic of the temperature can be analyzed to detect various operational fault conditions and provide an indication of the fuel formulation, especially when combined with other information available to typical engine control systems. By integrating the electronics necessary for controlling electrical power to the heater element into the heated fuel injector, a heated fuel injector is provided that is easily adapted for use by engine control system that already use open-loop heater control strategies. By providing a connection to the temperature signal within the heated fuel injector, the heater control circuit may be turned on or off, or the target control temperature for heating fuel may be adjusted.

While this invention has been described in terms of the preferred embodiments thereof, it is not intended to be so limited, but rather only to the extent set forth in the claims that follow.

We claim:

1. A heated fuel injector system for heating fuel dispensed by a heated fuel injector, said system comprising:

a heated fuel injector operable to controllably dispense a fuel;

a heater element arranged to heat the fuel dispensed by the heated fuel injector; and a temperature sensing means configured to output a temperature signal indicative of a fuel temperature of the fuel dispensed by the heated fuel injector.

2. The system in accordance with claim 1, wherein the temperature signal directly corresponds to the fuel temperature of the fuel dispensed by the heated fuel injector.

3. The system in accordance with claim 1, wherein the heater element is formed of thick-film material.

4. The system in accordance with claim 1, wherein the temperature sensing means comprises a thermistor arranged to exhibit a thermistor resistance indicative of the fuel temperature.

5. The system in accordance with claim 4, wherein the temperature signal is based on the thermistor resistance.

6. The system in accordance with claim 4, wherein the thermistor and the heater element are distinct devices.

7. The system in accordance with claim 1, wherein the heater element exhibits a heater resistance indicative of the fuel temperature and the output signal is based on the heater resistance.

8. The system in accordance with claim 1, said system further comprising a controller configured to receive the temperature signal, and regulate electric power to the heater element based on the temperature signal.

9. The system in accordance with claim 8, wherein the controller comprises a comparator means arranged to receive the temperature signal and a reference signal, and output a switch control signal based on the temperature signal and the reference signal.

10. The system in accordance with claim 8, wherein the controller is integrated into the heated fuel injector.

11. The system in accordance with claim 8, wherein the controller is further configured to determine an operating condition based on the temperature signal.

12. The system in accordance with claim 11, wherein the operating condition indicated by the temperature signal is indicative of one or more of a) an empty injector condition, b) a low fuel pressure condition, c) a lack of fuel flow condition, and d) an onset of fuel boiling condition.

13. The system in accordance with claim 11, wherein the operating condition indicated by the temperature signal is indicative of an ethanol percentage of the fuel in the heated fuel injector.

14. The system in accordance with claim 11, wherein the operating condition indicated by the temperature signal is indicative of a presence of water in the heated fuel injector.

15. The system in accordance with claim 1, wherein the temperature sensing means comprises a temperature indicator circuit configured to exhibit an electrical characteristic indicative of the fuel temperature.

16. The system in accordance with claim 15, wherein the temperature indicator circuit electrically couples the heater element to an injector actuator coil.

17. The system in accordance with claim 15, wherein the temperature indicator circuit is electrically coupled in parallel with an injector actuator coil.

18. The system in accordance with claim 1, wherein the temperature sensing means is further configured to receive a signal to influence the fuel temperature of the fuel dispensed by the heated fuel injector.

19. A controller for operating a heated fuel injector, said controller comprising:

a temperature signal input configured to receive a signal indicative of a fuel temperature of a fuel dispensed by the heated fuel injector; and an electric power regulator means configured to regulate electric power to a fuel heater element based on the temperature signal.

20. The controller in accordance with claim 19, said controller further comprising a power switch configured to regulate electric power to the heater element, and an injector actuator coil driver configured to output a signal to an injector actuator coil within the heated fuel injector.

* * * * *